United States Patent [19]

Symons

[11] Patent Number: 4,506,190

[45] Date of Patent: Mar. 19, 1985

[54] LINEAR BEAM TUBE WITH REFLECTED ELECTRON TRAP

[75] Inventor: Robert S. Symons, Los Altos, Calif.

[73] Assignee: Varian Associates, Inc., Palo Alto, Calif.

[21] Appl. No.: 423,767

[22] Filed: Sep. 27, 1982

[51] Int. Cl.[3] ..... H01J 23/08

[52] U.S. Cl. ..... 315/5.35; 315/5.38; 315/4; 315/5; 315/5.39

[58] Field of Search ..... 315/5.35, 5.38, 5.39, 315/5.51, 5.52, 4, 5, 3.6; 330/4.7

[56] References Cited

U.S. PATENT DOCUMENTS

| | | | |
|---|---|---|---|
| 3,072,817 | 1/1963 | Gordon | 330/4.7 X |
| 3,258,706 | 6/1966 | Sturrock | 315/3.6 X |
| 3,302,053 | 1/1967 | Udelson | 315/5.38 |
| 3,398,376 | 8/1968 | Hirshfield | 330/4.7 |
| 3,433,992 | 3/1969 | Tancredi et al. | 315/3.6 |
| 3,463,959 | 8/1969 | Jory et al. | 315/5 |
| 3,902,098 | 8/1975 | Tanaka et al. | 315/5.51 |
| 4,392,078 | 7/1983 | Noble et al. | 315/5.35 |

*Primary Examiner*—Saxfield Chatmon

*Attorney, Agent, or Firm*—Stanley Z. Cole; Richard B. Nelson; Peter J. Sgarbossa

[57] ABSTRACT

Some electrons reflected from the collector of a klystron form a beam current flowing back toward the input end of the tube. This beam is modulated and can carry a regenerate signal which distorts the tube's performance when amplifying a television signal. The reflected electrons are removed by a spiralling transverse magnetic field having a pitch equal to the cyclotron wavelength in the axial magnetic field used to focus the beam. The rotative sense of the spiral is such that forward-going beam electrons are not affected but returning electrons are accelerated in their cyclotron orbits until they are driven outside the beam and are collected.

11 Claims, 6 Drawing Figures

LINEAR BEAM TUBE WITH REFLECTED ELECTRON TRAP

FIELD OF THE INVENTION

The invention pertains to linear beam electron tubes used to amplify microwaves, particularly waves having amplitude-modulated signals such as television video signals. Klystrons are widely used for this purpose. The invention may also be incorporated in traveling-wave tubes.

A problem which has long bothered television transmitter klystrons has been identified as caused by electrons returning from the collector backward along the beam path toward the electron gun. The harmful electrons travel with approximately the velocity of the original beam. They are called either "reflected electrons" or "high speed secondary electrons".

In passing through the klystron cavities, the stream of returning electrons is velocity modulated by the cavity voltages and thereby bunched by the klystron mechanism to form a beam with modulated current density. This secondary radio-frequency current passing through the input (or other upstream) cavity induces voltage in the cavity exactly the same as modulated primary beam current, since the klystron cavity is completely bi-directional. The final effect is signal regeneration—highly non-linear in amplitude and phase.

Two undesirable effects are produced by such regeneration:

(1) Wiggles in the amplitude transfer characteristic which are manifested as brightness discontinuities in the picture;

(2) A phenomenon known as "sync pulse ringing".

The latter phenomenon may be explained as follows. At the end of each scan line (and frame), a sharp synchronizing pulse is transmitted at an amplitude near the peak saturation output of the transmitter. This pulse has very fast rise and fall time, limited only by the transmitter bandwidth. The gain of the klystron varies during the rise and fall due to the delay in build-up or falloff of voltages in the cavity as a result of their high Qs. When regeneration is added, the voltages can overshoot their equilibrium values, creating a ringing after the rise or fall of the pulse.

PRIOR ART

Several schemes have been tried to prevent such signal regeneration by reducing the number of backstreaming electrons. One scheme depends on the fact that the percentage yield of high speed secondary electrons from a bombarded surface is an increasing function of atomic number. Thus the collector surface is coated with a material of low atomic number. Carbon is effective, but greatly increases the time required to de-gas the tube. U.S. Pat. No. 4,233,539 issued Nov. 11, 1980 to Louis R. Falce and assigned to the assignee of this application, describes an improved aluminum boride coating which is much easier to outgas.

Another prior-art scheme is to modify the geometry of the collector to reduce the probability of secondary electrons re-entering the drift tube. U.S. Pat. No. 3,936,695 issued Apr. 26, 1974 to Robert C. Schmidt and assigned to the assignee of this application, describes a series of baffles inside the collector designed to permit passage of the entering beam, but intercept some of the secondaries.

Still another scheme is described in U.S. Pat. No. 3,806,755 issued Apr. 23, 1974 to E. L. Lien and M. E. Levin and also assigned to the assignee of this application. Its purpose is to statistically reduce the fraction of reflected electrons re-entering the collector entrance aperture by removing the bombarded surface as far as possible from the aperture.

All of the above-mentioned schemes have proven to help reduce regeneration. Each of them, however, only *reduces* the number of backstreaming electrons, and does not eliminate them.

Several attempts have been made to eliminate backstreaming electrons by magnetic fields transverse to the beam axis. Because magnetic fields deflect moving charges in accord with the "handedness" rule, returning electrons would be deflected in a direction opposite to that direction in which the forward beam would be deflected. Therefore, in principle the returning electrons could be separated from the forward beam and collected. None of these schemes has had any commercial success, due to high cost and to difficulties associated with the asymetric geometry and non-uniform collector dissipation characteristic of these schemes.

Of course, many other examples of more sophisticated schemes utilizing the interaction of magnetic field with an electron beam can be found in the prior art, but they have been directed to other purposes, and have not been of any help regarding the backstreaming electron problem. For example, U.S. Pat. No. 3,398,376 to Hirshfield describes an electron cyclotron maser which generates and amplifies electromagnetic radiation in the microwave and millimeter wave bands. Such generation and amplification is achieved by subjecting a beam of electrons immersed in a longitudinal magnetic field to the action of a corkscrew magnetic or electric field to impart a spiral trajectory, and with the spiralling beam then passing through a cavity having a mode frequency equal to the cyclotron frequency of the spiralling electrons. The action of corkscrew field increases the transverse velocity of the electron beam at the expense of its axial velocity, making possible interaction with the transverse fields in the cavity. Again, however, such schemes have not provided a solution for the backstreaming electron problem.

SUMMARY OF THE INVENTION

An object of the invention is to provide a linear-beam tube having negligible regeneration.

A further object is to provide a tube having uniform collector dissipation.

A further object is to provide a tube which is cheap to manufacture.

These objects are achieved by incorporating along the beam path a direction-sorting trap for electrons. A periodic transverse magnetic field rotates with distance opposite to the sense in which the forward-traveling beam electrons rotate in the axial uniform field used for focusing the beam. The time average of the periodic forces on forward electrons is zero. The period of the transverse field is about equal to the cyclotron wavelength. Returning electrons see the sense of rotation of the transverse field to be the same as their cyclotron rotation, so they are accelerated to larger cyclotron orbits and eventually strike the drift tube and are collected.

DESCRIPTION OF THE PREFERRED EMBODIMENTS

Figure 1:
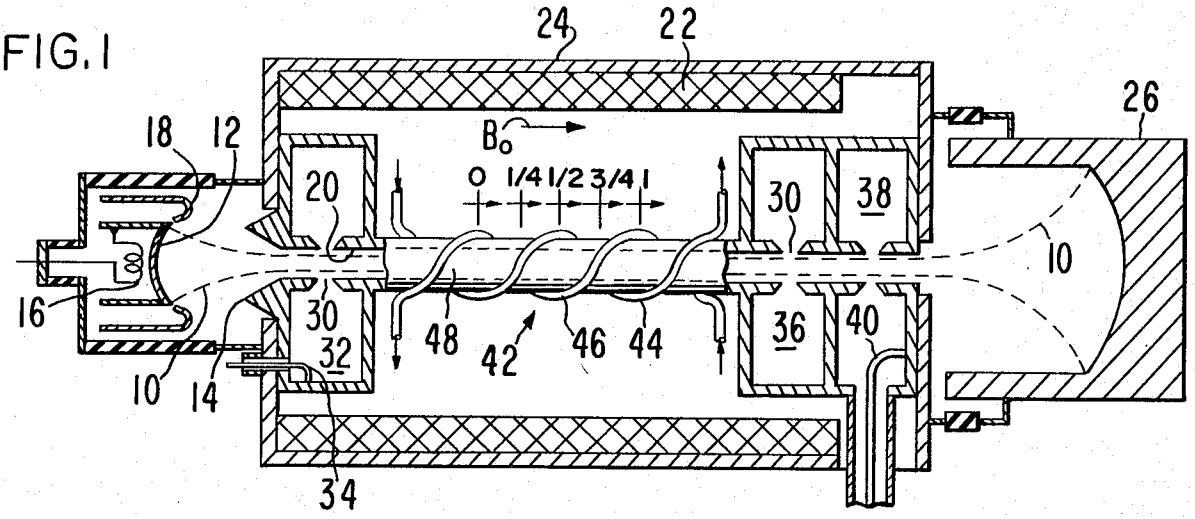
FIG. 1 is a schematic partial section of a klystron embodying the invention.

FIG. 1 illustrates a klystron embodying the invention. Klystrons are widely used as amplifiers in UHF television transmitters. The invention should find its greatest utility in klystrons which suffer from regeneration by backstreaming electrons. Backstreaming also occurs in traveling-wave tubes. The regeneration is less in TWTs because the reflected beam, traveling opposite to the primary rf circuit wave, is not synchronous with it and hence, will be modulated to a much lesser extent than is the case in klystrons. Nevertheless, the invention can produce some improvement in TWT performance.

In FIG. 1 a beam of electrons 10 is drawn from a thermionic cathode 12 by a positive potential on a hollow anode 14. Cathode 12 is heated by radiation from a resistive heater 16. Beam 10 is focused by a focusing electrode 18 to a small diameter to pass thru a long, hollow drift tube 20. Along the length of drift tube 20, beam 10 is kept focused in a pencil shape by the uniform axial field of a solenoid magnet coil 22. The flux return path is provided by a surrounding iron shell 24. After transit of drift tube 20, beam 10 leaves the magnetic field, spreads out and is collected in a hollow collector 26.

Spaced along drift tube 20 are a number of resonant interaction cavities having gaps 30 which are crossed by beam 10. These cavities include an input cavity 32 having a coupling loop 34 for introducing an input microwave signal, an uncoupled cascade cavity 36 and an output cavity 38 having an output loop 40 to extract radio-frequency power. The cavities support the microwave signal in energy-exchanging relationship with the electron beam, with the beam undergoing linear velocity modulation in passing through the successive cavities as is well understood in the art. Of course, klystron cavities are not the only circuit means which can enable such linear velocity modulation; the slow-wave structures of traveling wave tubes are another typical example.

A portion of drift tube 20 between input cavity 32 and output cavity 38 is used for the inventive reflected-electron trap 42. Trap 42 comprises means for producing a periodic magnetic field transverse to the axis of beam 10, the periodicity being such that the direction of the transverse field rotates with distance along the beam. The pitch of rotation is equal to the axial distance an electron travels in one cyclotron period. In FIG. 1 this spiralling transverse magnetic field is produced by a bifilar pair of conductive helices 44, 46 wrapped around but insulated from an extended portion of drift tube 48. Helices 44, 45 are fed direct current in opposing rotational sense as shown by the arrows at the ends of the helices. The magnetic field of these currents traveling through the helices is mainly transverse to the axis of beam 10, and rotates with the pitch of helices 44, 46.

FIG. 2 illustrate the operation of the periodic magnetic field. They represent cross-sections taken at successive transverse planes labeled 0, $\frac{1}{4}$, $\frac{1}{2}$, $\frac{3}{4}$ and 1, across drift tube 48 in FIG. 1, the fractions referring to the fractions of a cycle of rotation of helices 44, 46. The arrows 50, 52, into and out of the plane of the paper, indicate the angular position of helices 44, 46 and the direction of direct current in them. The vector $B_P$ indicates the direction of the principal component of the spiralling transverse magnetic field. The vector F indicates the direction of the induced magnetic force on a forward electron 54 (represented by a small circle) as its axial motion into the paper cuts the transverse field $B_P$. The dashed arc 56 indicates the cyclotron trajectory of forward electron 54 in the axial magnetic field $B_O$, which is directed into the paper, and which is provided by solenoid 22.

Figure 2A:
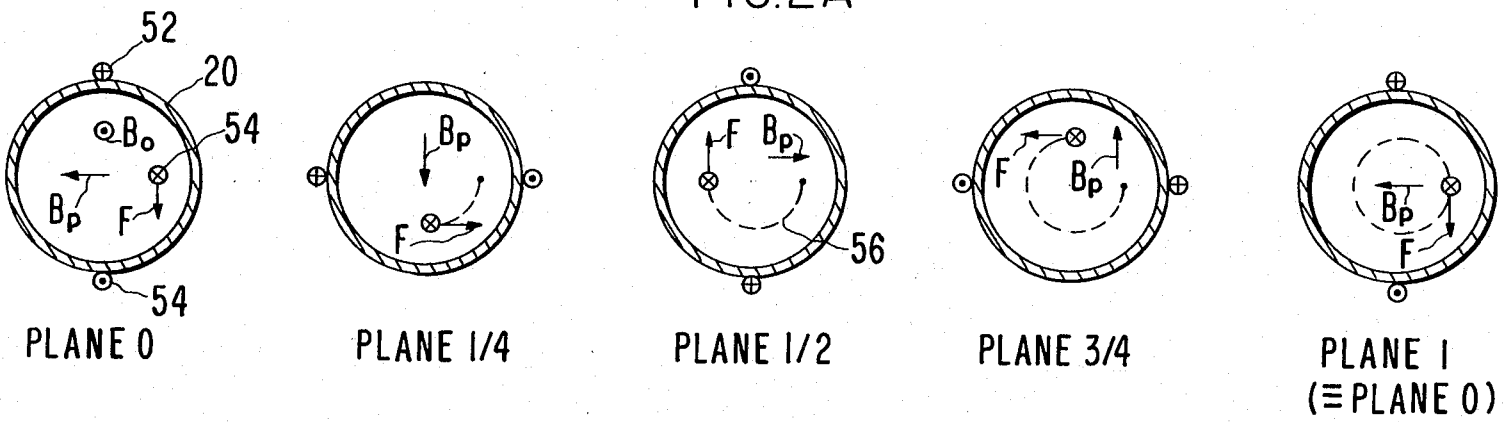
FIG. 2A is a diagram of the magnetic deflection of an electron in the primary beam.

FIG. 2A represents the forces on and motions of a forward electron 54 moving downstream from cathode to collector. At plane 0 the transverse field force is downward, tending to accelerate electron 54 in its clockwise cyclotron orbit. At plate $\frac{1}{4}$, force F is to the right, opposing the cyclotron motion and decelerating it. At plane $\frac{1}{2}$ the force is again accelerating the cyclotron motion, and at plane $\frac{3}{4}$ again decelerating the cyclotron motion. At plane 1,the conditions are again the same as at plane 0. Thus for an electron of the primary beam, the transverse magnetic field has no net effect, since electron 54 has been accelerated half the time and decelerated the other half, averaging to zero then for a forward electron its normal cyclotron orbit under the influence of the axial magnetic field remains virtually unchanged.

Figure 2B:
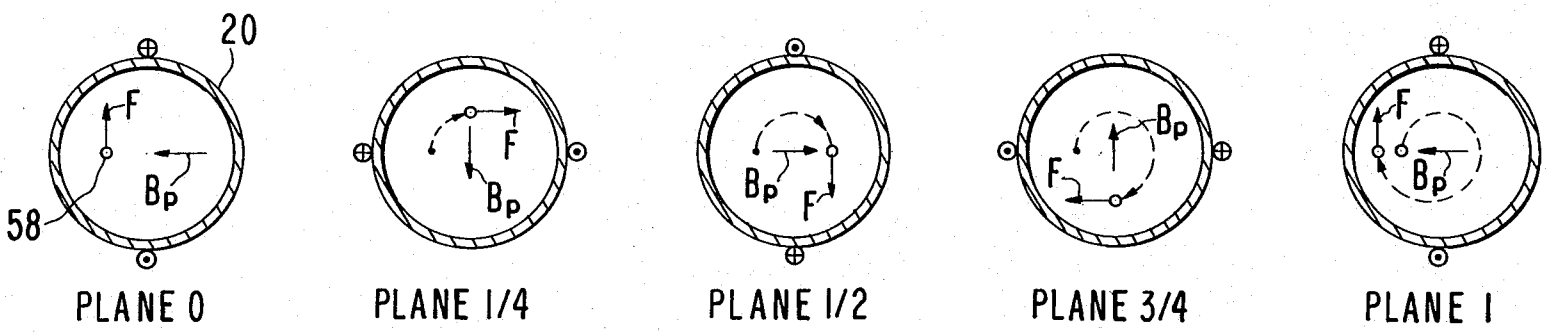
FIG. 2B is a diagram of the magnetic deflection of a reflected electron.

FIG. 2B illustrates the forces and motions of a reflected electron 58, whose axial motion is out of the plane of the paper. Its cyclotron motion under axial field $B_O$ will be in the opposite rotational sense to that of a forward electron 54, and is represented by lashed arc 56'. At plane 0, force F is upward, accelerating reflected electron 58 in its cyclotron orbit. At plane $\frac{1}{4}$, reflected electron 58 has completed $\frac{1}{4}$ of a cyclotron orbit and the transverse field $B_P$ has rotated the same amount, so force F is again accelerating the cyclotron motion. This condition continues through the entire orbit if the axial pitch of the transverse field rotation is approximately equal to the axial distance an electron travels during one cyclotron orbital period. As reflected electron 58 is continually accelerated, the diameter of its cyclotron orbit 56' becomes even larger. Eventually it strikes the wall of drift tube 20 and is removed from the backstreaming beam. The principle is analogous to that seen at the first stage of the device of the Hirshfield patent referred to above, in which the transverse velocity of the electron beam is also increased at the expense of the axial velocity. But here, an electron filter or trap is provided, not amplification.

Since the electron trap 42 is essentially axially symmetrical as was seen above in the FIGS. 2 explanations, there is no net displacement of forward beam 10 from its axial symmetry. Thus, no forward electrons are collected, and the distribution of primary beam current reaching the collector is still axially symmetrical. This eliminates some of the problems of non-uniform dissipation encountered in prior-art traps which used lateral deflection of the whole beam.

Figure 3:
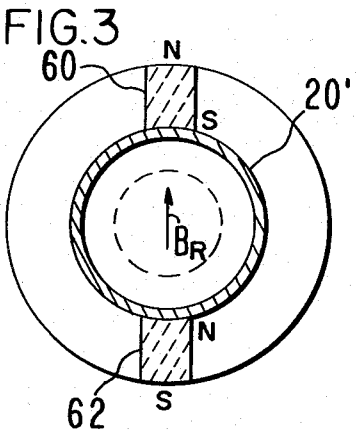
FIG. 3 is a section of an alternative embodiment.

FIG. 3 is an axial section of a slightly different embodiment wherein the spiralling transverse magnetic field is produced by a pair of permanent magnets 60, 62 spiralling longitudinally around drift tube 20'. They are radially magnetized in opposite direction, so that at any given axial cross-section, their magnetizations are in the same direction, as shown.

Figure 4A:
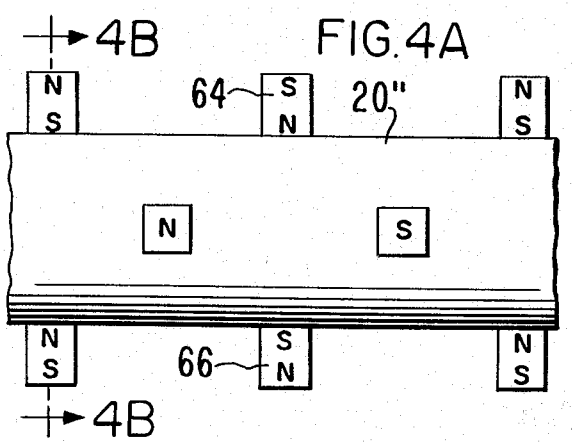
FIG. 4*a* and FIG. 4*b* are a side view and a section view of another embodiment of opposed pairs of discrete magnets arrayed along drift tube 20.
Figure 4B:
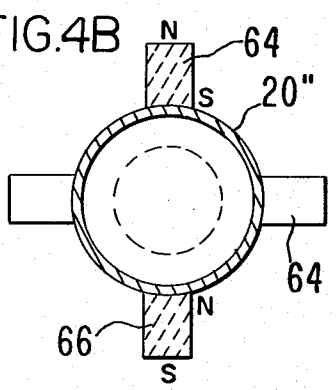

FIGS. 4A and 4B are respectively a side view and a section perpendicular to the axis of another embodiment. Here, instead of the expensive long spiral magnets of FIG. 3, opposed pairs of discrete magnets 64, 66 are arrayed successively along drift tube 20''. For each such approved pair, for example magnets 64 and 66, the magnetization is in the same direction (as in FIG. 3). The successive opposed pairs rotate in their orientation with distance along the axis, with a pitch as defined above. In the illustrated embodiments, the pairs are shown as spaced by $\frac{1}{4}$ the pitch and rotated by 90° from the preceding pair. This is not a requirement. Any integral number of pairs greater than one could be used to make one axial pitch.

It will be obvious to those skilled in the art that the invention might be embodied in a variety of other forms. Other velocity-modulated linear-beam tubes other than those above discussed can benefit from the invention. Indeed, this invention is also applicable in other vacuum tube applications, including density-modulated electron-beam tubes, CRTs, and for ion-trap applications. The described embodiments are exemplary and not limiting. The invention is to be limited only by the following claims and their legal equivalents.

I claim:

1. A linear-beam electron tube for generating high-frequency electromagnetic waves comprising:

means for generating a linear-beam of electrons;

circuit means for supporting an electromagnetic wave for linear velocity modulation of said beam to obtain energy exchange between said beam and said wave, said means including an axial passageway for transit of said beam;

means for collecting said beam after transit of said circuit means;

means for extracting electro magnetic energy from said circuit means;

means providing a magnetic field directed along the axis of said passageway for focusing said beam in a uniform cross-section thru said passageway; and means for generating a periodic magnetic field transverse to said axis along a portion of said beam, said periodic field rotating in orientation with distance along said axis with a pitch approximately equal to the distance traversed by an electron of said beam in one cyclotron period of said electron in said axial magnetic field, said periodic field rotation in a sense opposite to the sense of cyclotron rotation of electron in said axial magnetic field, whereby electrons traveling away from said beam generating means experience in said transverse field a transverse acceleration averaging to zero, and electrons traveling backward toward said beam generating means experience a cumulative transverse acceleration, driving them out of said beam.

2. The tube of claim 1 wherein said means for generating said periodic field comprises permanent magnets disposed on opposite sides of said axis and magnetized in the same direction in a section perpendicular to said axis.

3. The tube of claim 1 wherein said means for generating said periodic field comprises a bifilar helix of electrically conductive members surrounding said passageway.

4. In a linear beam, linear-velocity-modulated electron tube:

means for generating a linear beam of electrons, the path of said electrons defining an axis;

means providing a generally uniform magnetic field directed along said axis for focusing said beam in a uniform cross section along said axis; and means for generating a periodic magnetic field transverse to said axis along a portion of said beam, said periodic field rotating in orientation with distance along said axis with a pitch approximately equal to the distance transversed by an electron of said beam in one cylotron period of said electron in said uniform magnetic field, the rotation of said transverse periodic field being opposite to the cylotron rotation of electrons in said uniform magnetic field.

5. The tube of claim 4, which further includes means for collecting said beam at the end of said path.

6. The tube of claim 4, which further includes a drift tube defining said beam path.

7. The tube of claim 6, which further includes at least one resonant interaction cavity about said drift tube for linear velocity modulation of said electron beam by an electromagnetic input signal to enable energy-exchanging interaction therebetween.

8. The tube of claim 4, which further includes a slow-wave circuit for linear velocity modulation of said electron beam by an electromagnetic input signal to enable energy-exchanging interaction therebetween.

9. In a linear beam electron tube:

means for generating a linear beam of electrons;

circuit means providing a linear path for said beam and accepting an input electromagnetic signal for linear velocity modulation of said beam with said signal;

means providing a generally uniform magnetic field directed along said linear path for focusing said beam in a uniform cross section along said path; and means for generating a periodic magnetic field transversed to said linear path along a portion of said beam, said periodic field rotating in orientation with distance along said linear path with a pitch approximately equal to the distance traversed by an electron of said beam in one cyclotron period of said electron and said uniform magnetic field, said periodic field rotation in a sense opposite to the sense of the cyclotron rotation of electrons in said uniform magnetic field, whereby electrons traveling backward toward said generating means are driven out of said beam, while forward-traveling electrons experience no net effect.

10. The tube of claim 9, in which said means for generating said periodic magnetic field is situated within said means providing a uniform magnetic field.

11. The tube of claim 9, which further includes means for collecting said beam at the end of said path, some of the collected electrons escaping to give rise to said electrons travelling backward.

* * * * *